US011988053B2

(12) United States Patent
Egbe et al.

(10) Patent No.: US 11,988,053 B2
(45) Date of Patent: May 21, 2024

(54) SELECTIVELY BYPASSING FLOAT COLLAR

(71) Applicant: Saudi Arabian Oil Company, Dhahran (SA)

(72) Inventors: Peter Ido Egbe, Abqaiq (SA); Victor Jose Bustamante Rodriguez, Abqaiq (SA); Sajid Hussain, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/153,737

(22) Filed: Jan. 12, 2023

(65) Prior Publication Data

US 2023/0151705 A1 May 18, 2023

Related U.S. Application Data

(62) Division of application No. 17/185,459, filed on Feb. 25, 2021, now Pat. No. 11,598,167.

(51) Int. Cl.

| | |
|---|---|
| ***E21B 21/10*** | (2006.01) |
| ***E21B 21/00*** | (2006.01) |
| ***E21B 33/12*** | (2006.01) |
| ***E21B 34/06*** | (2006.01) |
| ***E21B 34/10*** | (2006.01) |
| ***E21B 47/13*** | (2012.01) |
| ***E21B 47/18*** | (2012.01) |

(52) U.S. Cl.

CPC ..... *E21B 21/10* (2013.01); *E21B 33/1208* (2013.01); *E21B 34/063* (2013.01); *E21B 34/101* (2013.01); *E21B 34/103* (2013.01); *E21B 47/13* (2020.05); *E21B 47/18* (2013.01); *E21B 21/00* (2013.01)

(58) Field of Classification Search

CPC .... E21B 21/10; E21B 33/1208; E21B 34/063; E21B 34/101; E21B 34/103; E21B 47/13; E21B 47/18; E21B 21/00; E21B 17/14; E21B 21/103; E21B 33/13; E21B 34/08

See application file for complete search history.

(56) References Cited

U.S. PATENT DOCUMENTS

| | | | | |
|---|---|---|---|---|
| 4,478,286 | A * | 10/1984 | Fineberg | E21B 34/101 166/324 |
| 6,401,822 | B1 | 6/2002 | Baugh et al. | |
| 6,679,336 | B2 | 1/2004 | Musselwhite et al. | |
| 6,712,145 | B2 * | 3/2004 | Allamon | E21B 21/10 166/332.8 |

(Continued)

FOREIGN PATENT DOCUMENTS

| | | |
|---|---|---|
| CN | 104563872 | 4/2015 |

*Primary Examiner* — James G Sayre

(74) *Attorney, Agent, or Firm* — Fish & Richardson P.C.

(57) ABSTRACT

A body defines a central flow passage. A check valve is located within the central flow passage. The check valve is supported by the body. The check valve is arranged such that a fluid flow travels in a downhole direction during operation of the float collar. An auxiliary flow passage is substantially parallel to the central flow passage and is defined by the body. The auxiliary flow passage includes an inlet upstream of the check valve and an outlet at a downhole end of the float collar. A rupture disk seals the inlet of the auxiliary flow passage. The rupture disk is configured to burst at a specified pressure differential.

16 Claims, 5 Drawing Sheets

(56) References Cited

U.S. PATENT DOCUMENTS

| | | | | |
|---|---|---|---|---|
| 7,640,984 | B2 | 1/2010 | Vert et al. | |
| 8,789,582 | B2 | 7/2014 | Rondeau et al. | |
| 9,303,482 | B2 | 4/2016 | Hall et al. | |
| 2004/0055749 | A1* | 3/2004 | Lonnes | E21B 23/04 166/373 |
| 2008/0277119 | A1 | 11/2008 | Hill et al. | |
| 2011/0290344 | A1* | 12/2011 | Groesbeck | E21B 34/16 137/430 |
| 2016/0053574 | A1* | 2/2016 | Miller | E21B 34/101 166/325 |
| 2018/0371869 | A1* | 12/2018 | Kellner | E21B 21/10 |

* cited by examiner

SELECTIVELY BYPASSING FLOAT COLLAR

This application is a divisional of and claims the benefit of priority to U.S. patent application Ser. No. 17/185,459, filed Feb. 25, 2021, contents of which are incorporated by reference herein.

TECHNICAL FIELD

This disclosure relates to float collars used in wellbore operations.

BACKGROUND

During well completion operations, cement, drill-in fluid, or brine is pumped down a workstring within a wellbore, and through a completion assembly at a downhole end of the workstring. The completion assembly includes a float shoe that contains a backpressure, or "check" valve that prevents fluids from entering the casing while the string is lowered into the hole and prevents cement, drill-in fluid, or brine from flowing back into the string after placement, enabling circulation down through the string.

A float collar is placed uphole (upstream) of the float shoe. The float collar acts as a barrier to prevent (or reduce the amount) influx of contaminants into the completion string during completion operations, casing operations, or both. The space between the float shoe and the float collar provides a containment area to entrap likely-contaminated fluids.

Float collars also include one or more check valves.

SUMMARY

This disclosure describes technologies relating to float collars with selective bypass passages.

An example implementation of the subject matter described within this disclosure is a float collar with the following features. A body defines a central flow passage. A check valve is located within the central flow passage. The check valve is supported by the body. The check valve is arranged such that a fluid flow travels in a downhole direction during operation of the float collar. An auxiliary flow passage is substantially parallel to the central flow passage and is defined by the body. The auxiliary flow passage includes an inlet upstream of the check valve and an outlet at a downhole end of the float collar. A rupture disk seals the inlet of the auxiliary flow passage. The rupture disk is configured to burst at a specified pressure differential.

An aspect of the example float collar, which can be combined with the example float collar alone or in combination, includes the following. The auxiliary flow passage includes an auxiliary check valve.

An aspect of the example float collar, which can be combined with the example float collar alone or in combination, includes the following. The check valve is a first check valve, the auxiliary flow passage is a first auxiliary flow passage, the specified pressure differential being a first specified pressure differential, and the rupture disk is a first rupture disk. The float collar further includes a second check valve located within the central flow passage. The second check valve is supported by the body. The second check valve is arranged such that a fluid flow travels in a downhole direction during operation of the float collar. A second auxiliary flow passage is substantially parallel to the central flow passage and is defined by the body. The auxiliary flow passage includes an inlet upstream of the second check valve and an outlet at a downhole end of the float collar. A second rupture disk seals the inlet of the auxiliary flow passage. The rupture disk is configured to burst at a second specified pressure differential different from the first pressure differential.

An aspect of the example float collar, which can be combined with the example float collar alone or in combination, includes the following. The second specified differential pressure is substantially 300-400 pounds per square inch higher than the first specified differential pressure.

An aspect of the example float collar, which can be combined with the example float collar alone or in combination, includes the following. The first check valve or second check valve includes plunger valves.

An aspect of the example float collar, which can be combined with the example float collar alone or in combination, includes the following. The float collar further includes a third auxiliary flow passage defined by the body. The third auxiliary flow passage includes an inlet upstream of the first check valve and the second check valve and an outlet at the downhole end of the float collar.

An aspect of the example float collar, which can be combined with the example float collar alone or in combination, includes the following. The float collar further includes a third auxiliary flow passage defined by the body. The third auxiliary flow passage encircles the first auxiliary flow passage, the second auxiliary flow passage, and the central flow passage.

An aspect of the example float collar, which can be combined with the example float collar alone or in combination, includes the following. The float collar further includes a third auxiliary flow passage defined by the body. A shearable seal is at the inlet of the third auxiliary flow passage.

An aspect of the example float collar, which can be combined with the example float collar alone or in combination, includes the following. The shearable seal is configured to shear to allow fluid flow through the third auxiliary flow passage at a specified pressure greater than the first specified differential pressure or the second specified differential pressure.

An aspect of the example float collar, which can be combined with the example float collar alone or in combination, includes the following. An actuator is configured to shear the shearable seal responsive to a signal from a controller.

An example implementation of the subject matter within this disclosure is a method with the following features. Fluid is flowed through a float collar positioned within a wellbore. A rupture disk is ruptured responsive to a clog within the float collar. Fluid is flowed through a bypass passage, within the float collar, responsive to the ruptured rupture disc.

An aspect of the example method, which can be combined with the example method alone or in combination, includes the following. The rupture disk is a first rupture disk, the clog is a first clog, and the bypass is a first bypass passage. The method further includes rupturing a second rupture disk responsive to a second clog in the first bypass passage. Fluid is flowed through a second bypass passage responsive to the second ruptured rupture disk.

An aspect of the example method, which can be combined with the example method alone or in combination, includes the following. A shear pin is sheared. Fluid is flowed through a third bypass passage responsive to shearing the shear pin.

An aspect of the example method, which can be combined with the example method alone or in combination, includes the following. Shearing the shear pin is responsive to a third clog in the second bypass passage.

An aspect of the example method, which can be combined with the example method alone or in combination, includes the following. Shearing the shear pin includes shearing the shear pin by an actuator actuated responsive to a signal received from a topside facility.

An aspect of the example method, which can be combined with the example method alone or in combination, includes the following. The signal comprises a circulated RFID tag.

An aspect of the example method, which can be combined with the example method alone or in combination, includes the following. The signal includes a mud pulse.

An aspect of the example method, which can be combined with the example method alone or in combination, includes the following. A confirmation signal by a mud pulse, produced by the float collar, is sent to a topside facility.

An example of the subject matter described in this disclosure is a float collar with the following features. A body defines a central flow passage. A first check valve is located within the central flow passage. The first check valve is configured to allow flow in a downhole direction during operation of the float collar. A first auxiliary flow passage is defined by the body. The first auxiliary flow passage includes an inlet upstream of the check valve and an outlet at a downhole end of the float collar. A first rupture disk seals the inlet of the auxiliary flow passage. The first rupture disk is configured to burst at a first specified differential pressure. A second check valve located within the central flow passage. The second check valve is arranged such that a fluid flow travels in a downhole direction during operation of the float collar. A second auxiliary flow passage is defined by the body. The auxiliary flow passage includes an inlet upstream of the second check valve and an outlet at a downhole end of the float collar. A second rupture disk seals the inlet of the auxiliary flow passage. The rupture disk is configured to burst at a second specified pressure differential different from the first specified differential pressure. A third auxiliary flow passage is defined by the body. The third auxiliary flow passage includes an inlet upstream of the first check valve and the second check valve and an outlet at the downhole end of the float collar. The third auxiliary flow passage encircles the first auxiliary flow passage, the second auxiliary flow passage, and the central flow passage. A shearable seal at is the inlet of the third auxiliary flow passage.

An aspect of the example float collar, which can be combined with the example float collar alone or in combination, includes the following. A controller is configured to receive a signal from a topside facility. The controller is configured to actuate an actuator to shear the shearable seal responsive to the received signal. The controller is configured to transmit a confirmation signal, as a mud pulse, to a topside facility.

Particular implementations of the subject matter described in this disclosure can be implemented so as to realize one or more of the following advantages. The concepts described herein reduce the number of trips necessary during completion operations in the event that a float shoe becomes plugged or clogged. Such a reduction in trips reduces the amount of rig time needed to complete a production or injection well. Aspects of the subject matter described herein provide the ability to circulate directly through the string close to bottom and have a primary mean of well control method in case a well influx is encountered. The subject matter described herein allow for the possibility to regain circulation path if float collars are plugged and retain the ability to spot freeing pills in the event of stuck pipe with the lower completion string. Alternatively or in addition, the subject matter described herein provides the ability to run the lower completion string to the plan depth, should the float collars be found plugged while deployment.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

During completion operations, float collars, float shoes, or both, can become plugged, halting completion operations. When such an event occurs, the only remedy is to remove or drill out the plug components, or pull the completion string to the surface to change out the plugged component. Such operations add a significant amount of time to well completion operations, increasing the time needed to use a completion rig, and delaying time to the start of production or injection.

This disclosure relates to a float collar that is able to direct fluid flow through auxiliary passages in the event of a blockage. Two of the auxiliary passages are actuated by rupturing a rupture disc at a set pressure. One additional flow passage is actuated by shearing a shear pin holding a flapper valve closed. The auxiliary passages also include check valves to prevent reverse flow through the collar. In some implementations, one or more of the auxiliary passages can be actuated by circulating a radio-frequency identification (RFID) tag. While primarily described in the context of a float collar, the concepts described herein can similarly be applied to a float shoe without departing from this disclosure.

Figure 1:
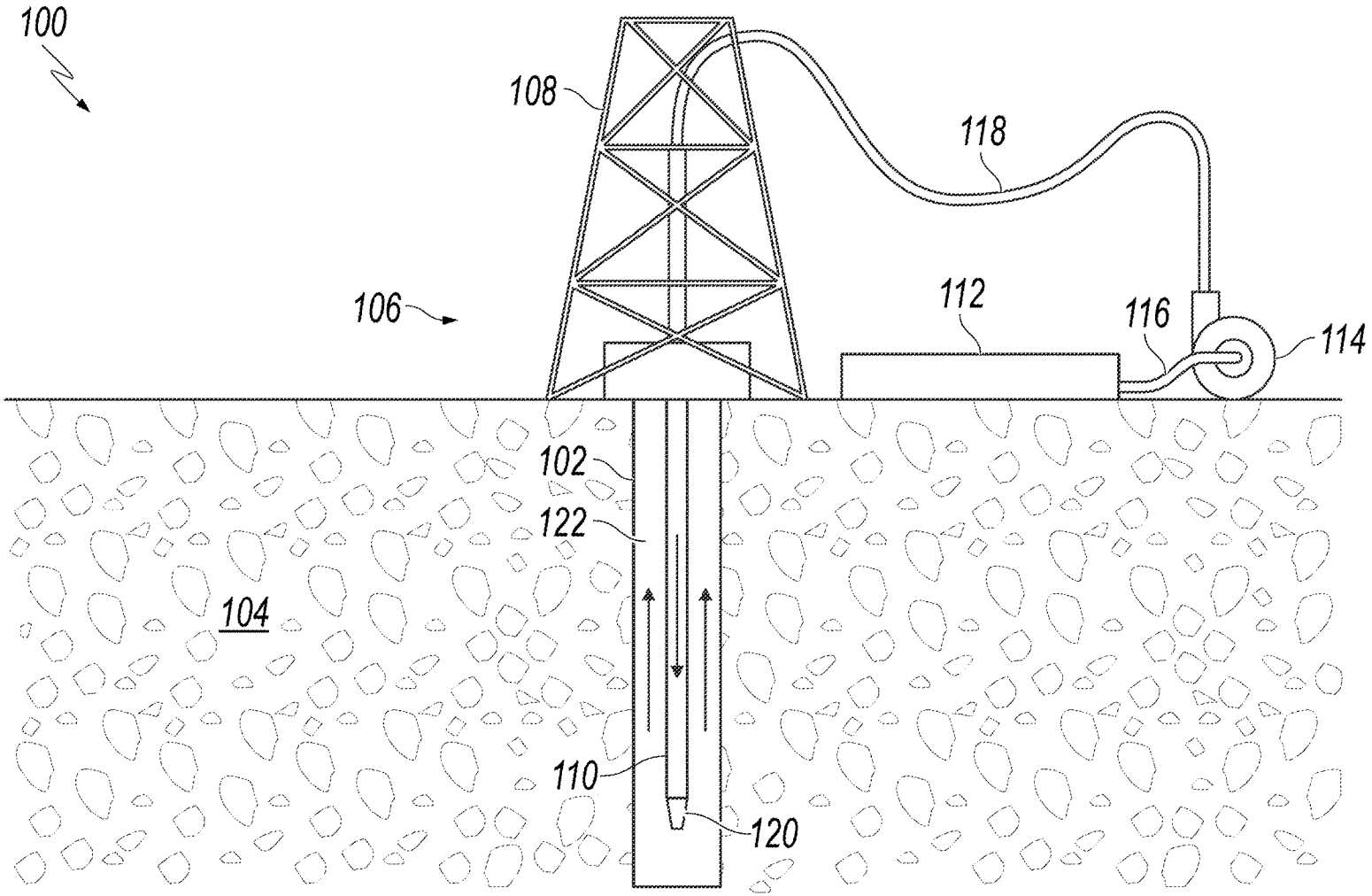
FIG. 1 is side cross-cross sectional diagram of an example wellsite.

FIG. 1 is side cross-sectional diagram of an example wellsite 100. The example wellsite 100 includes a wellbore 102 formed within a geologic formation 104. At an uphole end of the wellbore is a topside facility 106. The topside facility 106 includes a rig with a derrick 108 that supports a workstring 110 within the wellbore 102. The topside facility 106 includes a fluid mixing and storage system 112 that is fluidically connected to a rig pump 114 by a first conduit 116. The first conduit 116 can include piping, hoses, or any other conduit sufficient for the service. A discharge of the rig pump 114 is fluidically connected to the workstring 110 by a second conduit 118. The second conduit 118 is substantially similar to the first conduit 116 in that it can include piping and hoses rated for the service (such as, meeting material compatibility, inspection, and pressure requirements). At a downhole end of the workstring 110 is a bottom-hole assembly 120. Fluid (for example, cement, drill-in fluid, or brine) is pumped down the workstring 110, through the bottom-hole assembly, and up an annulus 122 defined by an outer surface of the workstring 110 and an inner surface of the wellbore 102. While illustrated as a vertical wellbore for simplicity, the wellbore 102 can be a horizontal or deviated wellbore without departing from this disclosure.

Figure 2:
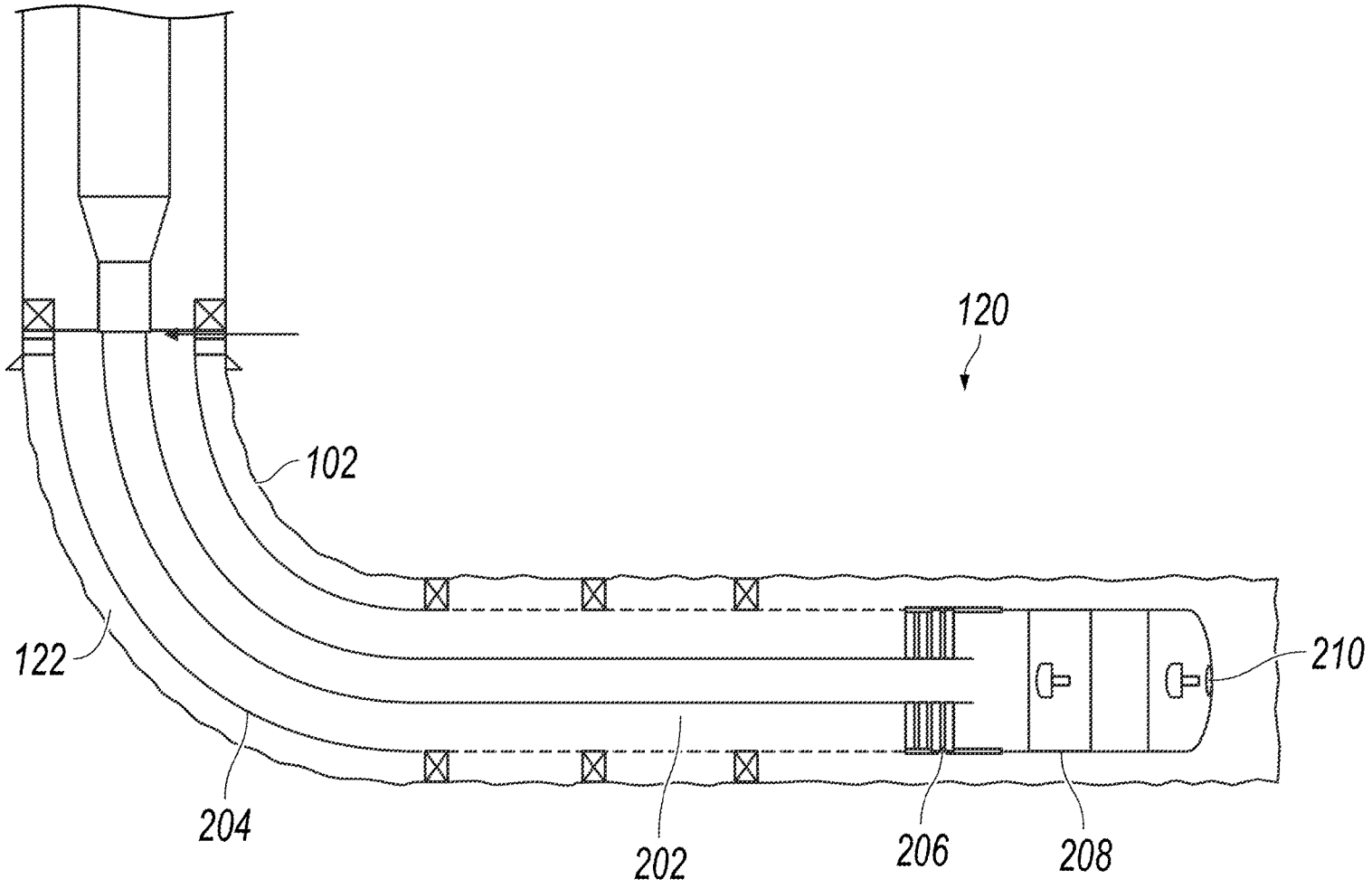
FIG. 2 is a side view of an example bottom-hole assembly.

FIG. 2 is a side view of an example bottom-hole assembly 120. The bottom-hole assembly 120 includes an inner string 202 and outer string 204. In some implementations, the outer string 204 includes a well casing. The inner string 202 carries the fluid and is stabbed, or "stung", into a polished bore receptacle (PBR) 206. This arrangement allows for the inner string 202 to be changed out as needed without removing the outer string 204 or the remainder of the bottom-hole assembly 120. The PBR 206 fluidically connects the inner string to a float collar 208. The float collar 208 includes check-valves to ensure the fluid flows in a downhole direction. More details about the float collar 208 are described throughout this disclosure. In some implementations, the float collar 208 is supported by a baffle plate, such as a spider or ring-type baffle plate. Downhole of the float collar 208 is a float shoe 210. The float shoe 210 is functionally similar to the float collar 208 in regards to flow regulation, that is, the float shoe 210 includes check valves to ensure fluid flows out of the bottom-hole assembly 120 and into the wellbore annulus 122. The float shoe 210 also defines an outer profile that allows the workstring to be inserted into the wellbore 102 with less interferences caused by snagging against the wellbore wall. Both the float shoe 210 and the float collar 208 are made of drillable materials, that is, materials soft enough to be removed with a conventional drill bit.

Figure 3:
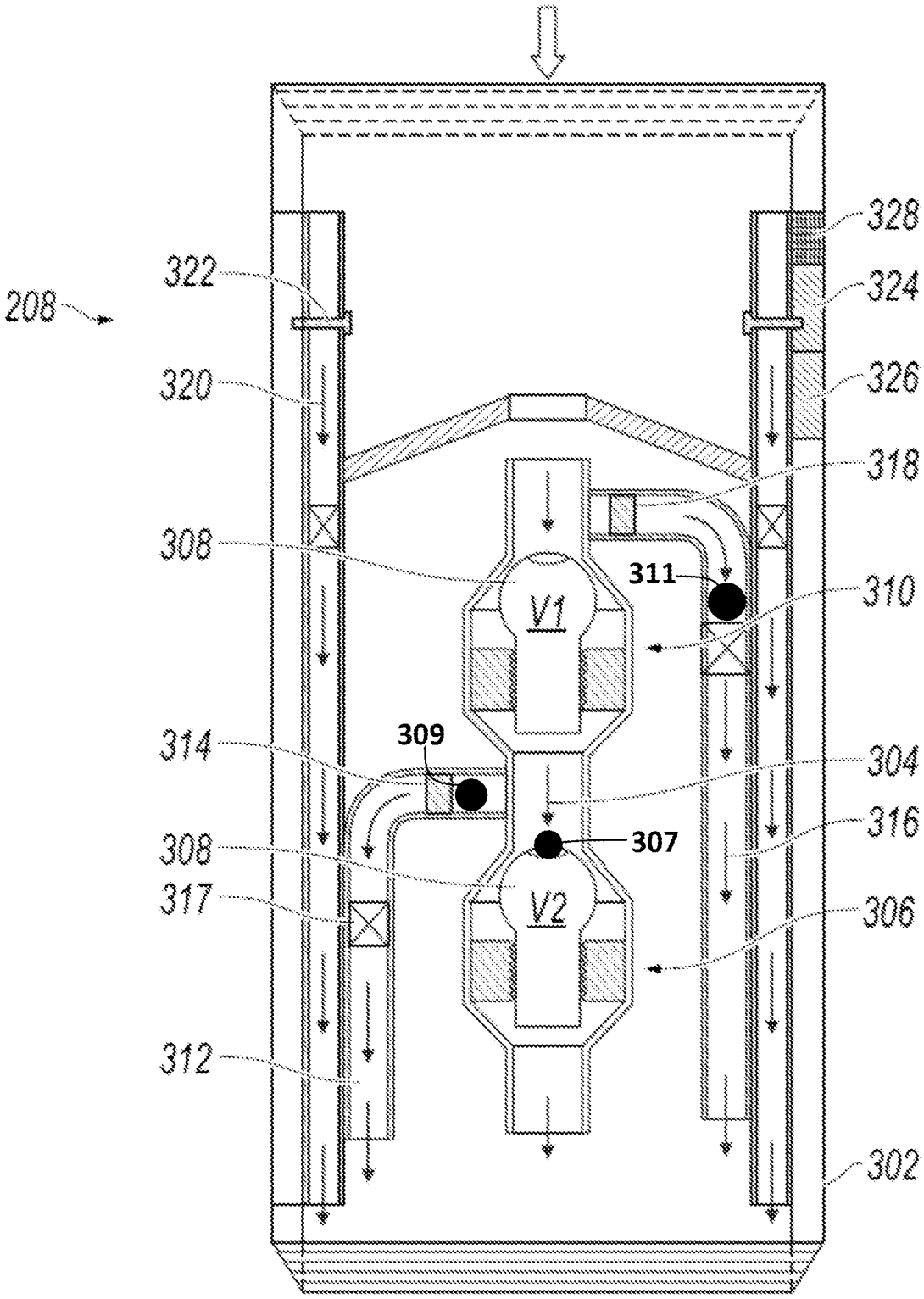
FIG. 3 is a side cross-sectional view of an example float collar.

FIG. 3 is a side cross-sectional view of an example float collar 208. The float collar 208 includes a body 302 that defines a central flow passage 304. A first check valve 306 is located within the central flow passage 304. The first check valve 306 is supported by the body 302, for example, by supports, such as a spider, or any other support mechanisms suitable for downhole service. The first check valve 306 is arranged such that a fluid flow travels in a downhole direction during operation of the float collar 208. In some implementations, the first check valve 306 can include a plunger valve. Such a valve is configured to have a plunger 308 move in an uphole direction to seal against a valve seat when a pressure downhole of the valve is greater than a pressure uphole of the valve. When pressure is greater on the uphole side of the valve than a downhole side of the valve, then the plunger 308 is separated from the seat to allow flow through the valve in a downhole direction.

In some implementations, a second check valve 310 is located within the central flow passage. The second check valve 310 is substantially similar to the first check valve 306 with the exception of any differences described herein. In the illustrated implementation, the second check valve 310 is upstream of the first check valve 306; however, other arrangements can be used without departing from this disclosure.

Between the first check valve 306 and the second check valve 310 is an inlet to a first auxiliary, or bypass, first auxiliary flow passage 312. The first auxiliary flow passage 312 primarily (that is, a majority of the length) and substantially (within standard manufacturing tolerances) extends parallel to the central flow passage and is similarly defined by the body 302. The first auxiliary flow passage 312 has an outlet at a downhole end of the float collar. A first rupture disk 314 seals the inlet of the first auxiliary flow passage 312. The first rupture disk 314 is a frangible disk that is configured to burst at a specified pressure differential. For example, in a situation where the first check valve becomes plugged or clogged (with a clog 307), a differential pressure across the first rupture disk 314 will increase to a point that the first rupture disk 314 will burst. The specified differential pressure is great enough that an accidental burst will not occur when the first check valve 306 (or the central flow passage 304 downstream of the first check valve 306) is not plugged or clogged. The first auxiliary flow passage 312 typically has a similar cross-sectional flow area as the central flow passage 304 to allow for similar flows in the event that the first rupture disk 314 is burst. In some implementations, the first auxiliary flow passage includes an auxiliary check valve 317 to ensure that flow continues in the desired direction.

A second auxiliary flow passage 316 has an inlet upstream of the second check valve 310. The second auxiliary flow passage 316 has a second rupture disk 318 sealing the inlet of the second auxiliary flow passage 316. The second auxiliary flow passage 316 and the second rupture disk 318 are substantially similar to the first auxiliary flow passage 312 and the first rupture disk 314, respectively, with the exception of any differences described herein. The second rupture disk 318 is configured to burst at a second specified pressure differential different from the first pressure differential. For example, the first rupture disk 314 and the second rupture disk 318 can be configured to burst sequentially. In such an implementation, the second rupture disk 318 is configured to rupture if the first auxiliary flow passage 312 becomes plugged or clogged (with a clog 309). To ensure that the first rupture disk 314 and the second rupture disk 318 rupture sequentially (rather than simultaneously), the second specified differential pressure can be set to substantially 300-400 pounds per square inch greater than the first specified differential pressure (within standard manufacturing tolerances). That is, the second rupture disk 318 bursts at a greater differential pressure than the first rupture disk 314.

A third auxiliary flow passage 320 is defined by the body 302. The third auxiliary flow passage includes an inlet upstream of the first check valve 306 and the second check valve 310 and an outlet at the downhole end of the float collar 208. In some implementations, the third auxiliary flow passage 320 is an annular-shaped flow passage that encircles the first auxiliary flow passage 312, the second auxiliary flow passage 316, and the central flow passage 304. At the inlet of the third auxiliary flow passage 320 is a shearable seal 322 at the inlet of the third auxiliary flow passage. That is, there is a shearable portion of the shearable seal 322 that can be sheared to open the third auxiliary flow passage 320. Once sheared, fluid is allowed to flow through the third auxiliary flow passage 320. In some implementations, the shearing can be caused by a specified pressure greater than the first specified differential pressure and the second specified differential pressure. In some implementations, an actuator 324 can be included with the float collar 208 to shear the shearable seal responsive to a signal from a controller 326 (based on a clog 311 in the second auxiliary flow passage 316).

While described primarily in the context of a float collar, the subject matter of the float collar described herein can be similarly applied to a float shoe without departing from this disclosure.

Figure 4:
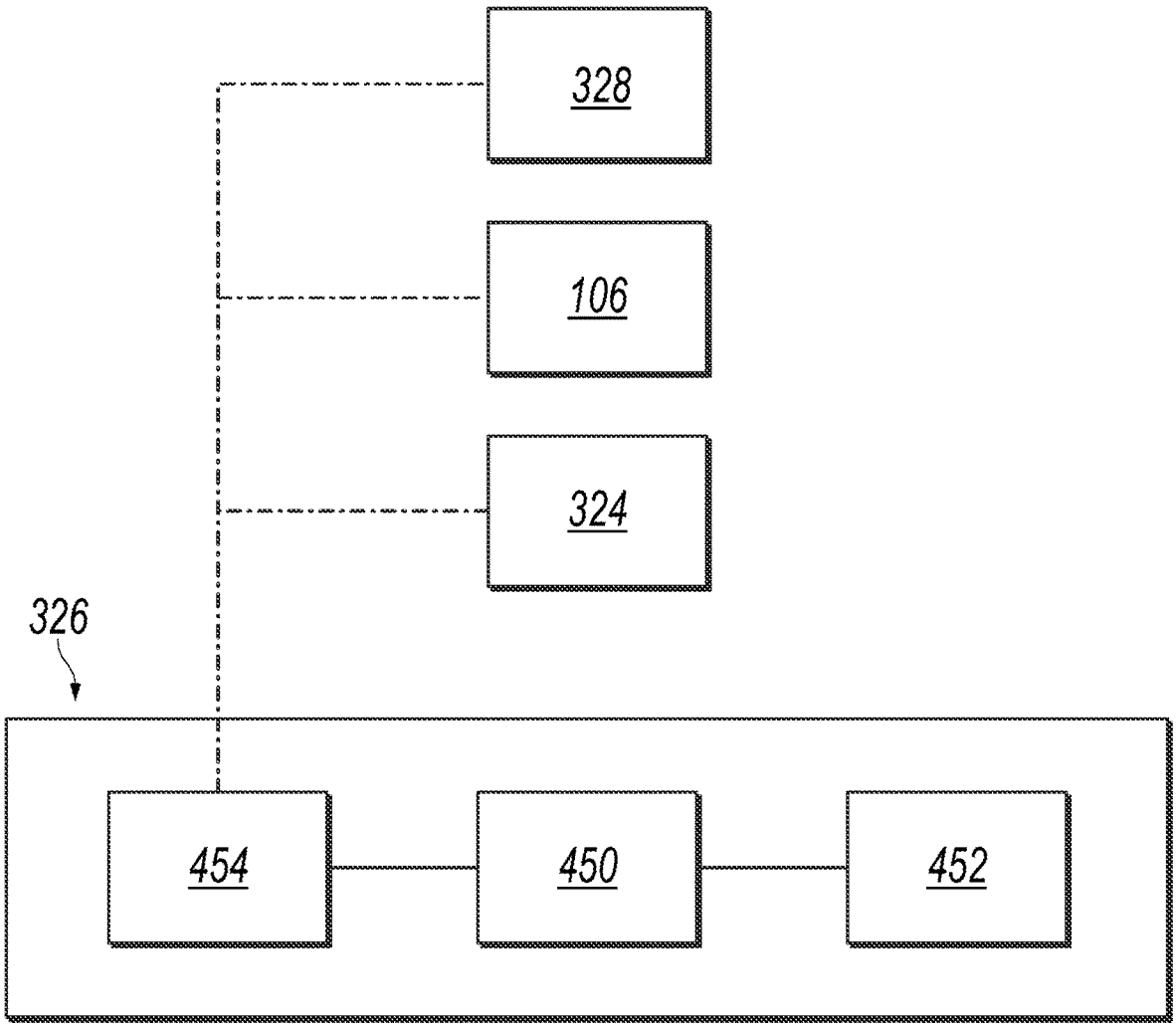
FIG. 4 is a block diagram of an example controller that can be used with aspects of this disclosure.

FIG. 4 is a block diagram of an example controller 326 that can be used with aspects of this disclosure. The controller 326 can, among other things, monitor parameters of the float collar 208 and send signals to actuate and/or adjust various operating parameters of the float collar. As shown in FIG. 4, the controller 326, in certain instances, includes a processor 450 (e.g., implemented as one processor or multiple processors) and a non-transitory memory 452 (e.g., implemented as one memory or multiple memories) containing instructions that cause the processors 450 to perform operations described herein. The processors 450 are coupled to an input/output (I/O) interface 454 for sending and receiving communications with components in the system, including, for example, the RFID reader 328. In certain instances, the controller 326 can additionally communicate status with and send actuation and/or control signals to one or more of the various system components (including an actuator 324 to shear the shearable seal 322) of the float collar 208, as well as other sensors (e.g., pressure sensors, RFID readers, and other types of sensors) provided in the float collar 208. In certain instances, the controller 326 can communicate status and send actuation and control signals to one or more of the components within the float collar 208, such as the actuator 324. The communications can be hard-wired, wireless, or a combination of wired and wireless. In some implementations, controllers similar to the controller 326 can be located elsewhere, such as in a control room, elsewhere on a site, or even remote from the site. In some implementations, the controller 326 can be a distributed controller with different portions located on or in the float collar 208, about a site, or off-site. Additional controllers can be used throughout the site as stand-alone controllers or networked controllers without departing from this disclosure.

The controller 326 can have varying levels of autonomy for controlling the float collar 208. For example, the controller 326 can receive a signal from the topside facility 106 by the RFID scanner or a pressure sensor detecting a mud-pulse or pressure change, and an operator manually controls the actuator 324 based on pressure readings provided to the topside facility. Alternatively, the controller 326 can receive a pressure stream indicative of a pressure differential across the float collar, and shear the shearable seal by the actuator 324 with no other input from an operator. Regardless, the controller can send a confirmation signal, for example, by a mud pulse, to the topside facility.

Figure 5:
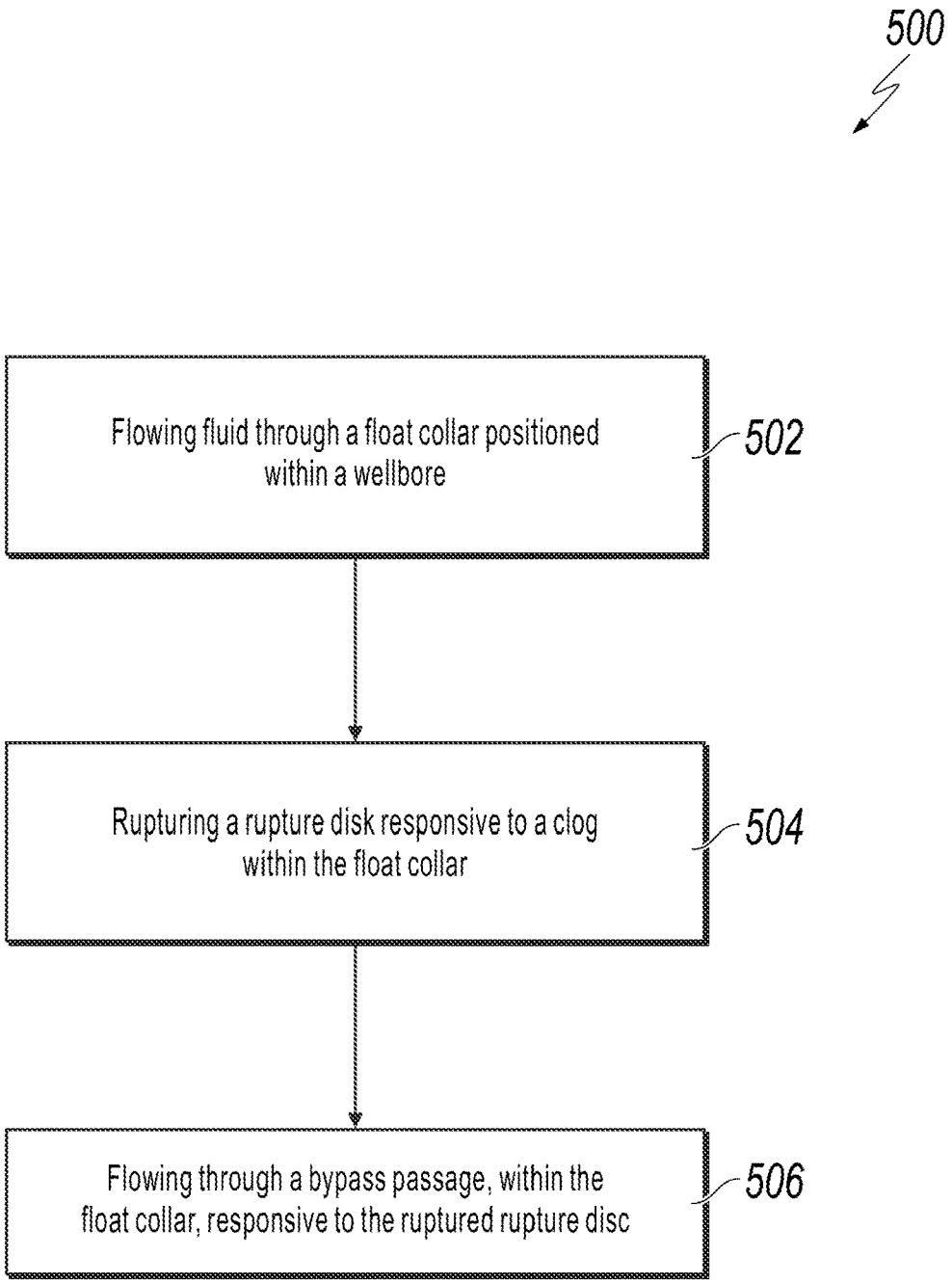
FIG. 5 is a flowchart of an example method that can be used with aspects of this disclosure.

FIG. 5 is a flowchart of an example method 500 that can be used with aspects of this disclosure. At 502, fluid is flowed through the float collar 208 positioned within a wellbore. At 504, a rupture disk is ruptured responsive to a clog within the float collar. At 506, fluid is flowed through a bypass passage, within the float collar, responsive to the ruptured rupture disc.

In some implementations, the rupture disk is a first rupture disk, the clog is a first clog, and the bypass is a first bypass passage. In such an implementation, a second rupture disk can be ruptured responsive to a second clog in the first bypass passage. Fluid is then flowed through a second bypass passage responsive to the second ruptured rupture disk.

In some instances, the second bypass passage can be clogged. In such instances, a shear pin can be sheared, and fluid can be flowed through a third bypass passage responsive to shearing the shear pin. Shearing the shear pin is responsive to a third clog in the second bypass passage. In some implementations, the shear pin can be sheared by a differential pressure caused by the clogged second bypass passage. In some implementations, the shear pin can be sheared by an actuator actuated responsive to a signal received from a topside facility. Such a signal can include a mud pulse or a circulated RFID tag. In some implementations, the float collar 208 can send a confirmation signal, for example, by a mud pulse, to the topside facility 106.

While this disclosure contains many specific implementation details, these should not be construed as limitations on the scope of any inventions or of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A method comprising:

flowing fluid through a float collar positioned within a wellbore;

rupturing a rupture disk responsive to a clog within the float collar; and flowing fluid through a bypass passage, within the float collar, responsive to the ruptured rupture disc.

2. The method of claim 1, wherein the rupture disk is a first rupture disk, the clog is a first clog, and the bypass is a first bypass passage, the method further comprising:

rupturing a second rupture disk responsive to a second clog in the first bypass passage; and flowing fluid through a second bypass passage responsive to the second ruptured rupture disk.

3. The method of claim 2, further comprising:

shearing a shear pin; and flowing fluid through a third bypass passage responsive to shearing the shear pin.

4. The method of claim 3, wherein shearing the shear pin is responsive to a third clog in the second bypass passage.

5. The method of claim 4, wherein shearing the shear pin comprises shearing the shear pin by an actuator actuated responsive to a signal received from a topside facility.

6. The method of claim 5, wherein the signal comprises a circulated RFID tag.

7. The method of claim 6, further comprising sending a confirmation signal by a mud pulse, produced by the float collar, to a topside facility.

8. The method of claim 7, further comprising sending a confirmation signal by a mud pulse, produced by the float collar, to a topside facility.

9. The method of claim 5, wherein the signal comprises a mud pulse.

10. The method of claim 5, further comprising sending a confirmation signal by a mud pulse, produced by the float collar, to a topside facility.

11. The method of claim 3, wherein shearing the shear pin comprises shearing the shear pin by an actuator actuated responsive to a signal received from a topside facility.

12. The method of claim 11, wherein the signal comprises a circulated RFID tag.

13. The method of claim 12, wherein the signal comprises a mud pulse.

14. The method of claim 11, wherein the signal comprises a mud pulse.

15. The method of claim 14, further comprising sending a confirmation signal by a mud pulse, produced by the float collar, to a topside facility.

16. The method of claim 11, further comprising sending a confirmation signal by a mud pulse, produced by the float collar, to a topside facility.

* * * * *